US007520548B1

(12) United States Patent
Liu

(10) Patent No.: US 7,520,548 B1
(45) Date of Patent: Apr. 21, 2009

(54) CHOPSTICKS GRIPPER

(76) Inventor: Ming-Huang Liu, No. 24, Lane 1, Dahan St., Shengang Township, Taichung County (TW)

( * ) Notice: Subject to any disclaimer, the term of this patent is extended or adjusted under 35 U.S.C. 154(b) by 0 days.

(21) Appl. No.: 11/868,685

(22) Filed: Oct. 8, 2007

(51) Int. Cl.
*A47G 21/10* (2006.01)

(52) U.S. Cl. ..... 294/99.2; 294/1.1

(58) Field of Classification Search ..... 294/1.1, 294/3, 8.5, 16, 99.2; D7/642, 644, 655, 686
See application file for complete search history.

(56) References Cited

U.S. PATENT DOCUMENTS 3,323,825 A * 6/1967 Arima ..... 294/99.2
D262,089 S * 12/1981 Fahy ..... 294/99.2
4,787,663 A * 11/1988 Laramie ..... 294/99.2
6,749,239 B2 * 6/2004 Choi ..... 294/99.2
7,182,378 B2 * 2/2007 Inomata et al. ..... 294/99.2
2007/0017540 A1 * 1/2007 Davis et al. ..... 132/150

FOREIGN PATENT DOCUMENTS

JP 2003-275085 * 9/2003

* cited by examiner

*Primary Examiner*—Paul T Chin
(74) *Attorney, Agent, or Firm*—Egbert Law Offices PLLC

(57) ABSTRACT

A chopsticks gripper article has a solid housing with a flexible inner layer therein. The flexible inner layer has a pair of chopstick-receiving through holes therein. The housing has a pair of upper through holes and a pair of lower through holes on opposite walls of the housing. A protruding portion extends downwardly from the housing and is positioned between the pair of lower through holes. A chopsticks blocking structure extends downwardly along opposite sides of the protruding portion. The protruding portion has sides that are inclined so as to converge away from the housing.

2 Claims, 5 Drawing Sheets

CHOPSTICKS GRIPPER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a chopsticks gripper, and more particularly to an innovative gripper an accessory device.

2. Description of Related Art Including Information Disclosed Under 37 CFR 1.97 and 37 CFR 1.98.

Chopsticks are an indispensable tool in the everyday life of Chinese people, which embodies the food culture of this nation.

However, the following shortcomings are observed during actual applications:

In the modern era where economic development has benefited from advanced technologies and foreign investment assistance, many foreign experts live and work in eastern countries but face the problem of learning how to use chopsticks expertly in everyday life and on many occasions.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention. The chopsticks gripper A has a blocky structure comprising a solid housing 10 and a flexible inner layer 20. The flexible inner layer 20 is provided with two chopsticks through-holes 21 arranged at intervals. The two upper through-holes 11 and two lower through-holes 12 are arranged oppositely onto the top and bottom wall of the solid housing 10. The upper through-hole 11 is of a long-shaped hole, and the spacing between the two upper through-holes 11 or between two chopsticks through-holes 21 is smaller than that between lower through-holes 12. So when the chopsticks are inserted into the through-holes in a normally open state, the newcomers can hold and use the chopsticks correctly, without need of any knowledge about chopsticks.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

FIGS. 1-5 depict preferred embodiments of chopsticks gripper (1) of the present invention. The embodiments are provided only for explanatory purposes. The scope of the patent is set by the patent claims.

Figure 1:
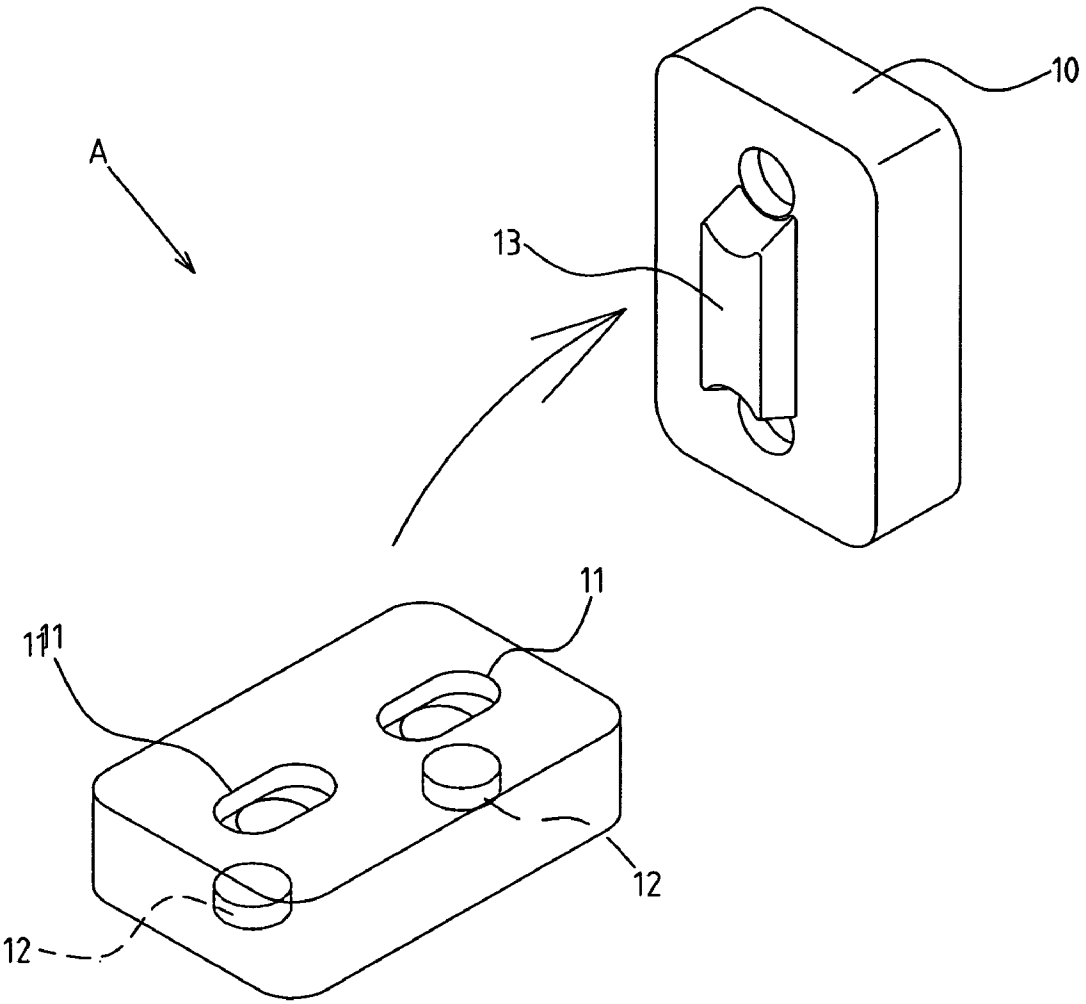
FIG. 1 shows an assembled perspective view of the present invention.
Figure 2:
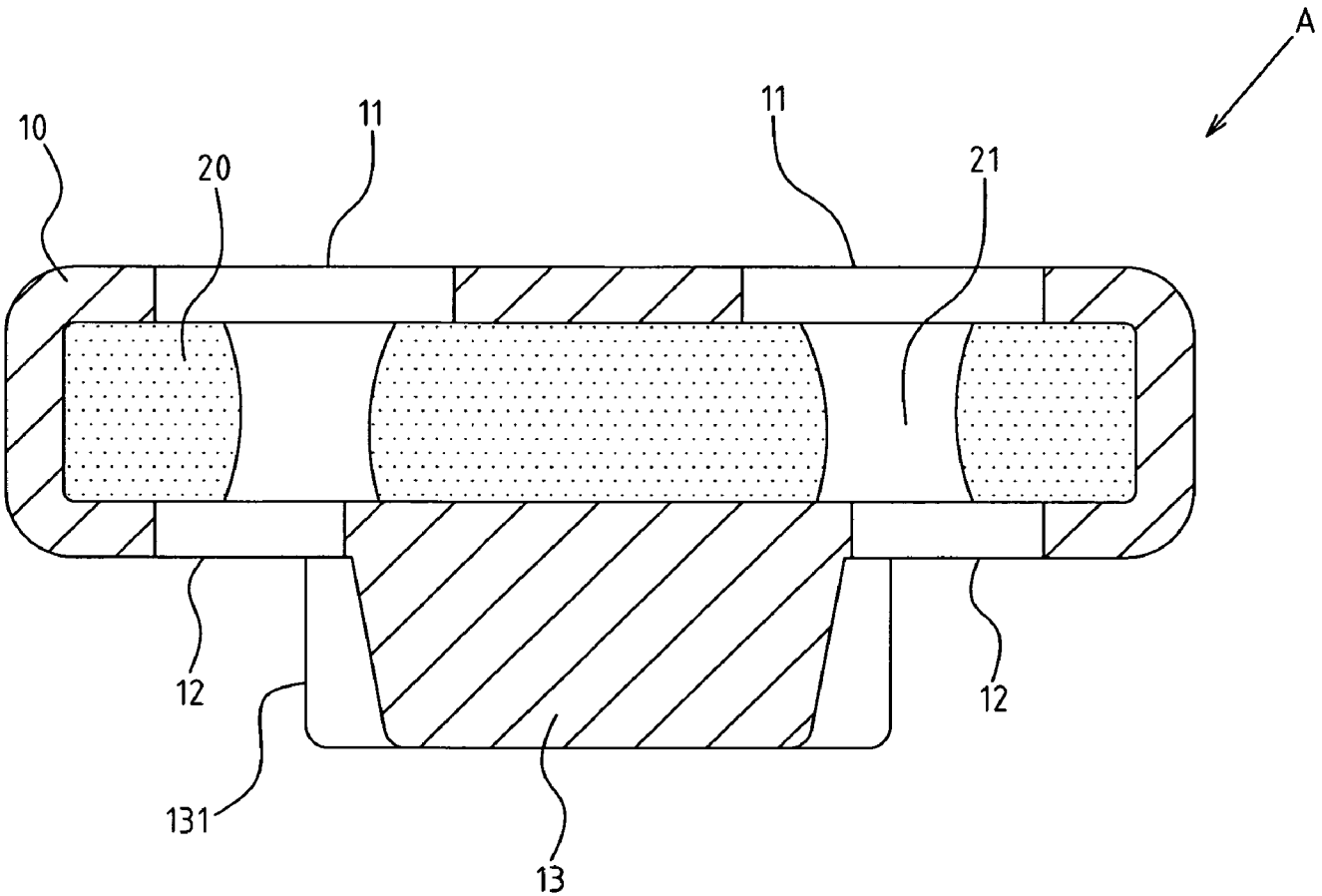
FIG. 2 shows an assembled sectional view of the present invention.

Referring to FIGS. 1-2, said chopsticks gripper A has a blocky structure comprising a solid housing 10 and a flexible inner layer 20. The flexible inner layer 20 is made of silicon gel and provided with two chopsticks through-holes 21 at intervals. The two upper through-holes 11 and two lower through-holes 12 are arranged oppositely onto the top and bottom wall of the solid housing 10. The upper through-hole 11 is of a long-shaped hole, and the spacing between the two upper through-holes 11 or between two chopsticks through-holes 21 is smaller than the spacing between the lower through-holes 12. A protruding portion 13 is placed between two lower through-holes 12 on the bottom wall of the solid housing. A chopsticks blocking surface 131 is formed at both sides of lower through-hole 12 corresponding to the protruding portion 13. The chopsticks blocking surface 131 is inclined downwards.

Figure 3:
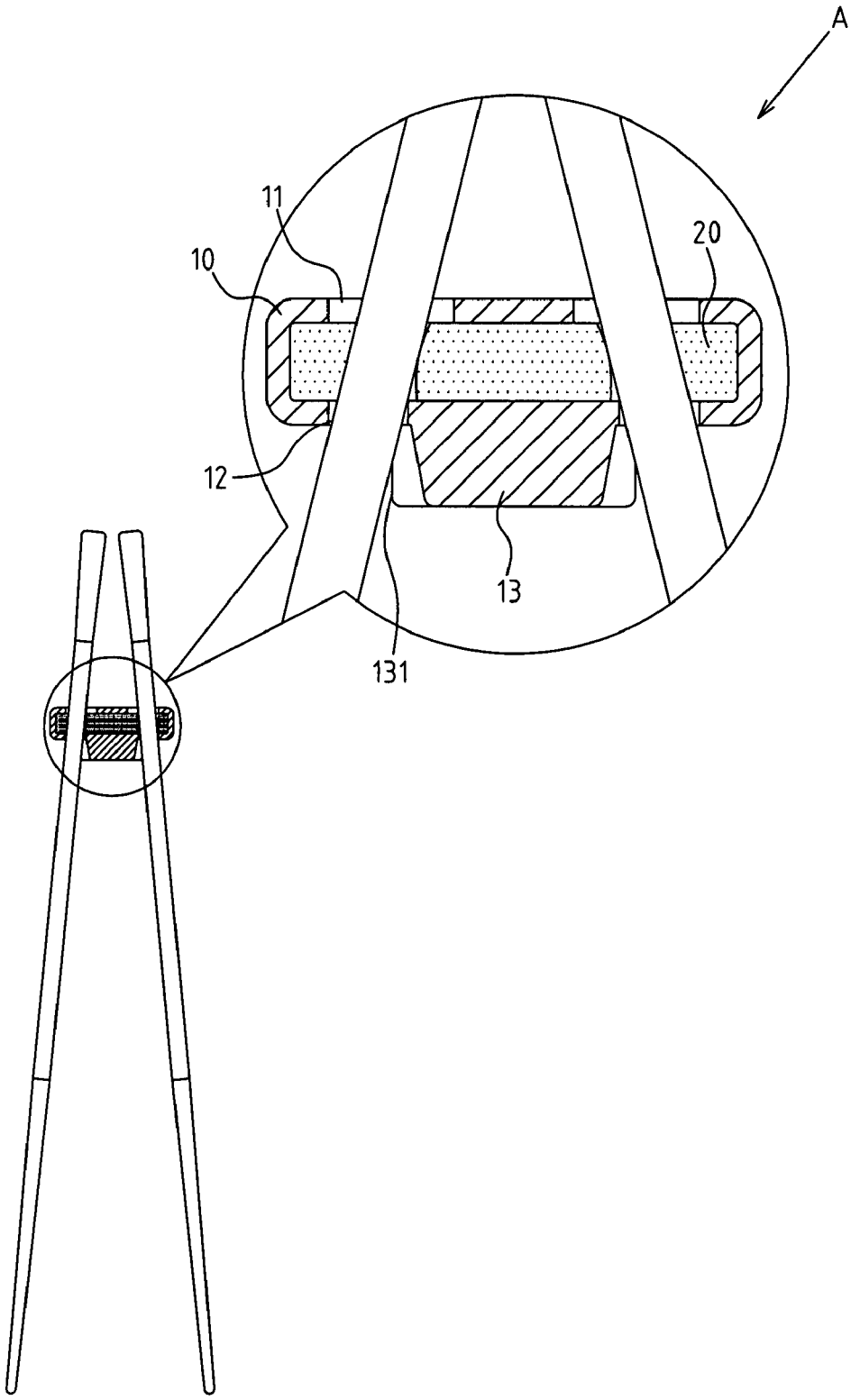
FIG. 3 shows an assembled elevation view and an isolated partial sectional view of the application of the present invention.
Figure 4:
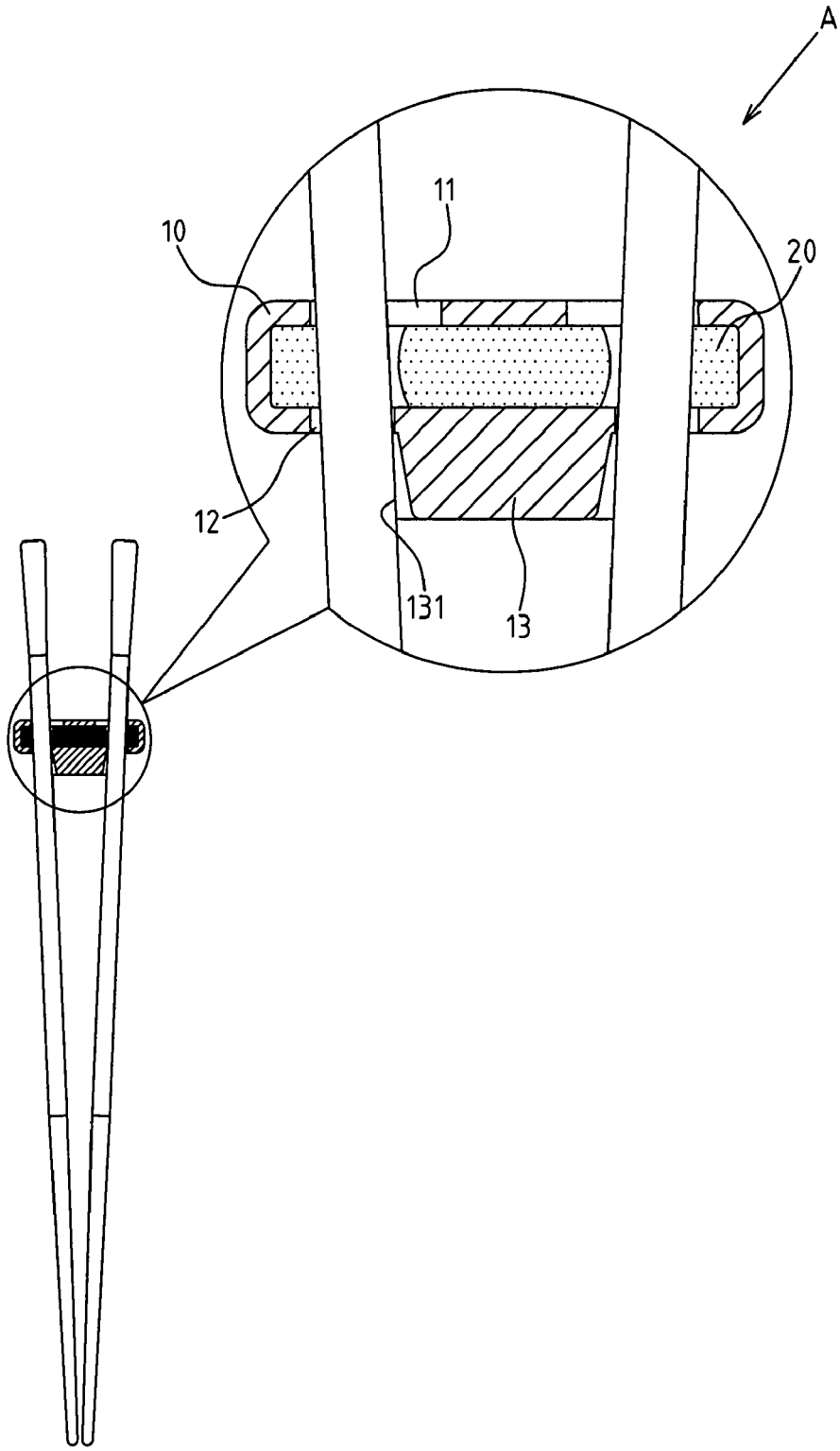
FIG. 4 shows another assembled elevation view and isolated partial sectional view of the application of the present invention.

Based upon the above-specified structures, the present invention is operable. Referring to FIG. 3, when chopsticks are inserted into chopsticks gripper A, the chopsticks are in a normally open state since the spacing between two upper through-holes 11 or between chopsticks through-holes 21 is smaller than that between lower through-holes 12. Referring also to FIG. 4, when force is applied to the chopsticks, the chopsticks at chopsticks through-hole 21 of flexible inner layer 20 are pressed towards both sides, and obliquely supported by chopsticks blocking surface 131 of the protruding portion 13, so that the end of chopsticks is in normally closed state.

Figure 5:
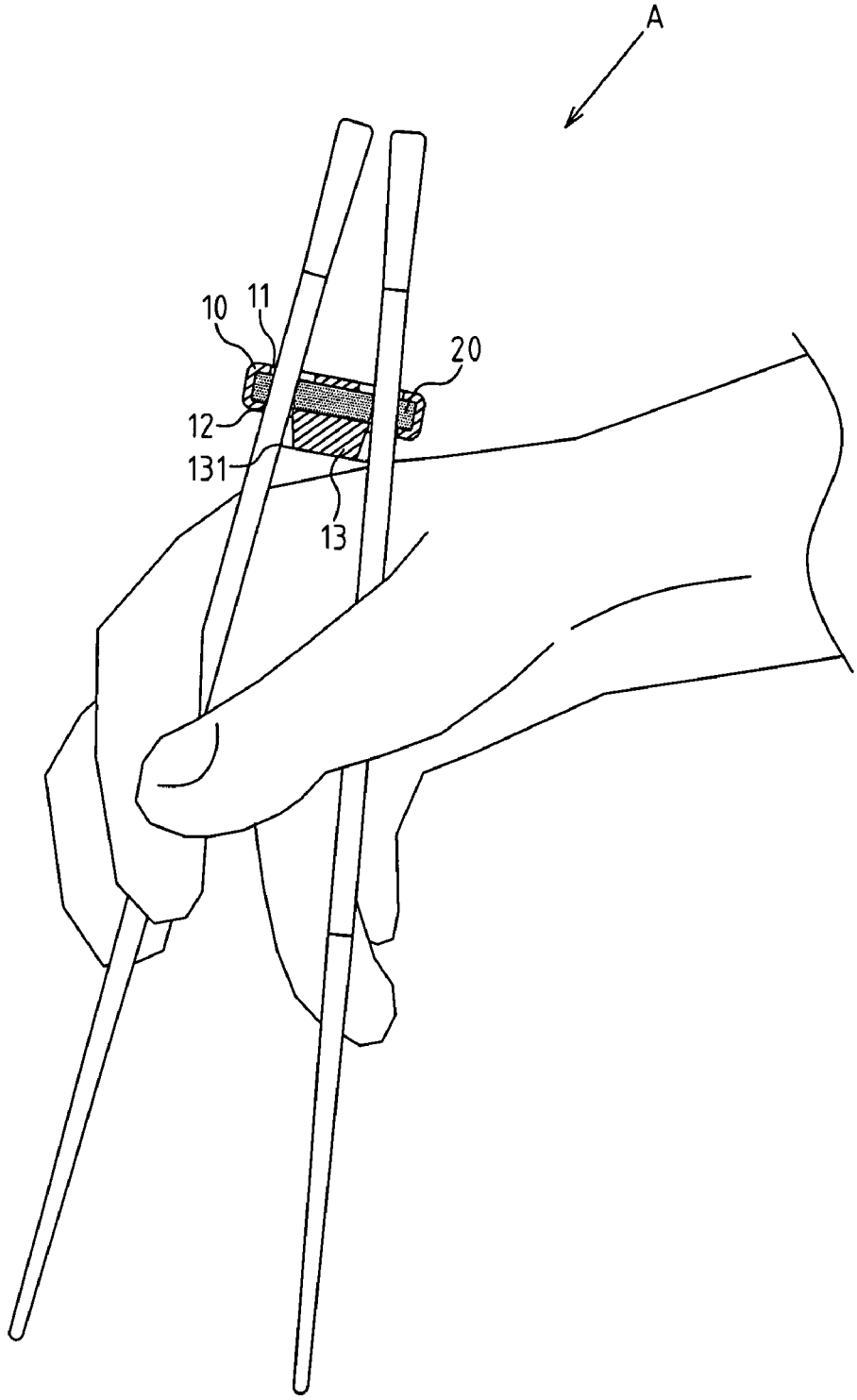
FIG. 5 shows a schematic view of the application of the present invention.

Referring to FIG. 5, the user manually holds the chopsticks gripper A in a correct manner.

I claim:

1. A chopstick gripper article comprising:

a housing having a pair of upper through holes formed in a top wall thereof and a pair of lower through holes formed in a bottom wall thereof, each of said pair of upper through holes having a diameter greater than a diameter of each of said pair of lower through holes;

a flexible inner layer formed in an interior of said housing, said flexible inner layer having a pair of through holes formed therein in spaced relation to each other, said pair of lower through holes having a distance center-to-center thereof, said pair of through holes of said flexible inner layer having a distance center-to-center thereof that is less than said distance of said pair of lower through holes, said pair of upper through holes having a distance center-to-center thereof that is less than said distance of said pair of lower through holes;

a protruding portion extending downwardly from said bottom wall of said housing, said protruding portion being positioned between said pair of lower through holes, said protruding portion having sides respectively adjacent said pair of lower through holes, said sides of said protruding portion being inclined so as to converge away from said bottom wall of said housing; and a chopsticks blocking surface formed adjacent said pair of lower through holes and extending downwardly from said bottom wall of said housing along said protruding portion.

2. The article of claim 1, said flexible inner layer being formed of a silicon gel material.

* * * * *